US011735823B2

(12) United States Patent
Carper et al.

(10) Patent No.: US 11,735,823 B2
(45) Date of Patent: Aug. 22, 2023

(54) COPLANAR ANTENNA STRUCTURE HAVING A WIDE SLOT

(71) Applicant: GM Global Technology Operations LLC, Detroit, MI (US)

(72) Inventors: Duane S. Carper, Davison, MI (US); Hyok Jae Song, Oak Park, CA (US); James H. Schaffner, Chatsworth, CA (US); Patrick Edward Leavy, Saint Clair Shores, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/575,069

(22) Filed: Jan. 13, 2022

(65) Prior Publication Data

US 2023/0223697 A1 Jul. 13, 2023

(51) Int. Cl.

| | |
|---|---|
| ***H01Q 13/08*** | (2006.01) |
| ***H01Q 9/04*** | (2006.01) |
| *H01Q 21/00* | (2006.01) |

(52) U.S. Cl.

CPC ..... *H01Q 9/045* (2013.01); *H01Q 13/085* (2013.01); *H01Q 21/0062* (2013.01)

(58) Field of Classification Search

CPC ..... H01Q 1/32; H01Q 1/1271; H01Q 1/1278; H01Q 1/1285; H01Q 13/08; H01Q 13/085; H01Q 13/10; H01Q 13/106; H01Q 13/16; H01Q 9/045; H01Q 9/0457

See application file for complete search history.

(56) References Cited

U.S. PATENT DOCUMENTS

| | | | | |
|---|---|---|---|---|
| 10,530,036 | B2 * | 1/2020 | Talty | H01Q 5/371 |
| 2006/0202898 | A1 * | 9/2006 | Li | H01Q 1/1271 343/713 |
| 2010/0066621 | A1 * | 3/2010 | Chang | H01Q 13/10 343/767 |
| 2016/0006112 | A1 * | 1/2016 | Kagaya | H01Q 9/16 343/712 |

(Continued)

FOREIGN PATENT DOCUMENTS

| | | | |
|---|---|---|---|
| CN | 111293430 | A * | 6/2020 |
| CN | 113571911 | A * | 10/2021 |

(Continued)

OTHER PUBLICATIONS

Marantis, et al. A CPW-Fed Bow-Tie Slot Antenna With Tuning Stub, 2008 Loughborough Antennas & Propagation Conference, published Mar. 17-18, 2008, pp. 389-392.

(Continued)

*Primary Examiner* — Ab Salam Alkassim, Jr.
*Assistant Examiner* — Leah Rosenberg
(74) *Attorney, Agent, or Firm* — Vivacqua Crane PLLC

(57) ABSTRACT

An antenna is disclosed. The antenna can include a coplanar antenna structure. The coplanar antenna structure can include a substrate and a radiating portion that is configured to emit electromagnetic radiation and is disposed over the substrate. The radiating portion defines a slot having a width to length ratio of at least approximately 0.4. The antenna also includes a scattering element disposed over the substrate and at least partially surrounds the radiating portion.

16 Claims, 2 Drawing Sheets

(56) References Cited

U.S. PATENT DOCUMENTS

| | | | | |
|---|---|---|---|---|
| 2016/0164185 | A1* | 6/2016 | Park | H01Q 1/24 343/700 MS |
| 2017/0324138 | A1* | 11/2017 | Talty | H01Q 1/1271 |
| 2019/0245256 | A1* | 8/2019 | Song | E06B 3/6608 |
| 2020/0028248 | A1* | 1/2020 | Kerselaers | H01Q 1/3275 |
| 2022/0278445 | A1* | 9/2022 | Woo | H01Q 21/08 |
| 2023/0033007 | A1* | 2/2023 | Lou | H01Q 9/045 |
| 2023/0163450 | A1* | 5/2023 | Lee | H01Q 1/48 343/702 |

FOREIGN PATENT DOCUMENTS

| | | | | |
|---|---|---|---|---|
| KR | 20040049154 | A | * | 6/2004 |
| WO | WO-2023058790 | A1 | * | 4/2023 |

OTHER PUBLICATIONS

Bhobe, et al., Wide-Band Slot Antennas With CPW Feed Lines: Hybrid and Log-Periodic Designs, IEEE Transactions on Antennas and Propagation, Oct. 2004, pp. 2545-2554, vol. 52, No. 10.

Shanmugananthan et al., CPW-Fed Slot Antenna For Wideband Applications, International Journal of Antennas and Propagation, Feb. 28, 2008, vol. 2008, Article ID 379247.

* cited by examiner

COPLANAR ANTENNA STRUCTURE HAVING A WIDE SLOT

INTRODUCTION

The present disclosure relates to coplanar antenna structure disposed within a transparent assembly, and more particularly to coplanar antenna structure having a wide slot.

Modern vehicles employ various and many types of antennas to receive and transmit signals for different communications systems, such as terrestrial radio (AM/FM), cellular telephone, satellite radio, dedicated short range communications (DSRC), Wi-Fi, GPS, etc. The antennas used for these systems are often mounted to a roof of the vehicle so as to provide maximum reception and/or transmission capability. These antennas can be integrated into a vehicle windshield because glass provides a good dielectric substrate for an antenna.

SUMMARY

An antenna is disclosed. The antenna can include a coplanar antenna structure. The coplanar antenna structure can include a substrate and a radiating portion that is configured to emit and/or receive electromagnetic radiation and is disposed over the substrate. The radiating portion defines a slot having a width to length ratio of at least approximately 0.4. The antenna also includes a scattering element disposed over the substrate and at least partially surrounds the radiating portion.

In other features, a width of the slot comprises at least approximately eight millimeters.

In other features, the slot has a length of at least approximately twenty millimeters.

In other features, an area of the slot comprises at least approximately one hundred and sixty millimeters.

In other features, the scattering element comprises a semi-circular ring structure.

In other features, the semi-circular ring structure comprises a non-segmented structure.

In other features, the antenna includes a feed line disposed over the substrate and connects the radiating portion to a coplanar waveguide (CPW) feed structure.

In other features, the antenna includes a laminated structure that includes the coplanar antenna structure.

In other features, the laminated structure comprises a first transparent substrate and a second transparent substrate bonded together via a binding material.

In other features, the binding material comprises Polyvinyl butyral (PVB).

A system is disclosed. The system can include a laminated structure and an antenna disposed within the laminated structure. The antenna can include a coplanar antenna structure, and the coplanar antenna structure can include a substrate and a radiating portion that is configured to emit and/or receive electromagnetic radiation and is disposed over the substrate. The radiating portion defines a slot having a width to length ratio of at least approximately 0.4. The coplanar antenna structure also includes a scattering element disposed over the substrate and at least partially surrounds the radiating portion.

In other features, a width of the slot comprises at least approximately eight millimeters.

In other features, the slot has a length of at least approximately twenty millimeters.

In other features, an area of the slot comprises at least approximately one hundred and sixty millimeters.

In other features, the scattering element comprises a semi-circular ring structure.

In other features, the semi-circular ring structure comprises a non-segmented structure.

In other features, the coplanar antenna structure includes a feed line disposed over the substrate and connects the radiating portion to a coplanar waveguide (CPW) feed structure.

In other features, the coplanar waveguide (CPW) feed structure is disposed over an external surface of the laminated structure.

In other features, the laminated structure comprises a first transparent substrate and a second transparent substrate bonded together via a binding material.

In other features, the binding material comprises Polyvinyl butyral (PVB).

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Those having ordinary skill in the art will recognize that terms such as "side," "front," "back," "above," "below," "upward," "downward," "top," "bottom," etc., are used descriptively for the figures, and do not represent limitations on the scope of the disclosure, as defined by the appended claims. Furthermore, the teachings may be described herein in terms of functional and/or logical block components and/or various processing steps.

Figure 2:
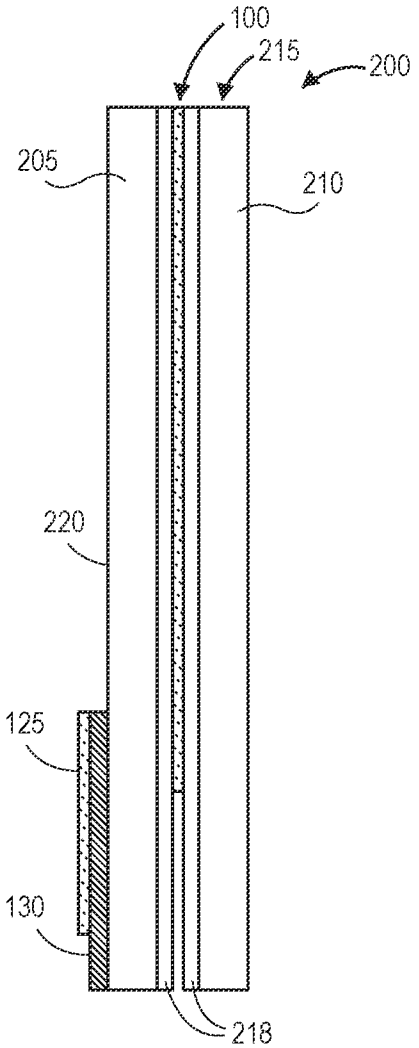
FIG. 2 is a diagram of a coplanar antenna structure disposed within a glass laminated structure.
Figure 1:
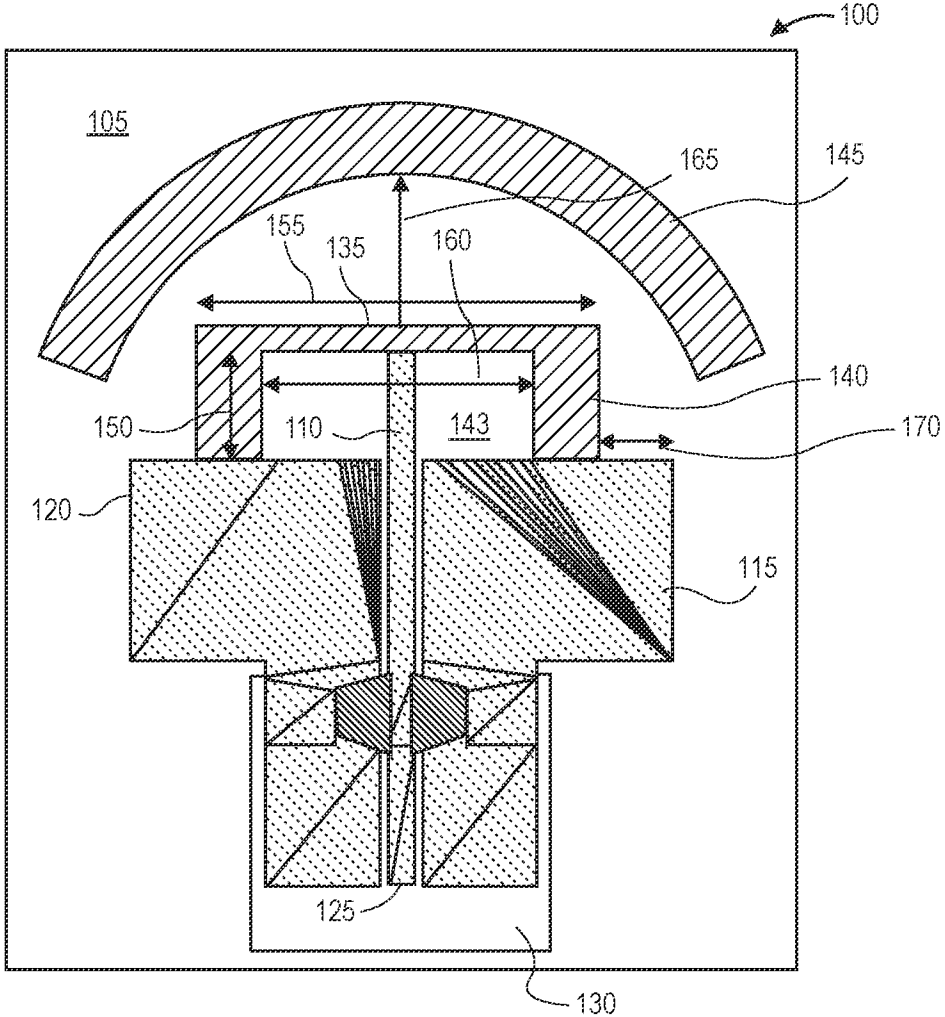
FIG. 1 is a diagram of an example coplanar antenna structure.
Figure 3:
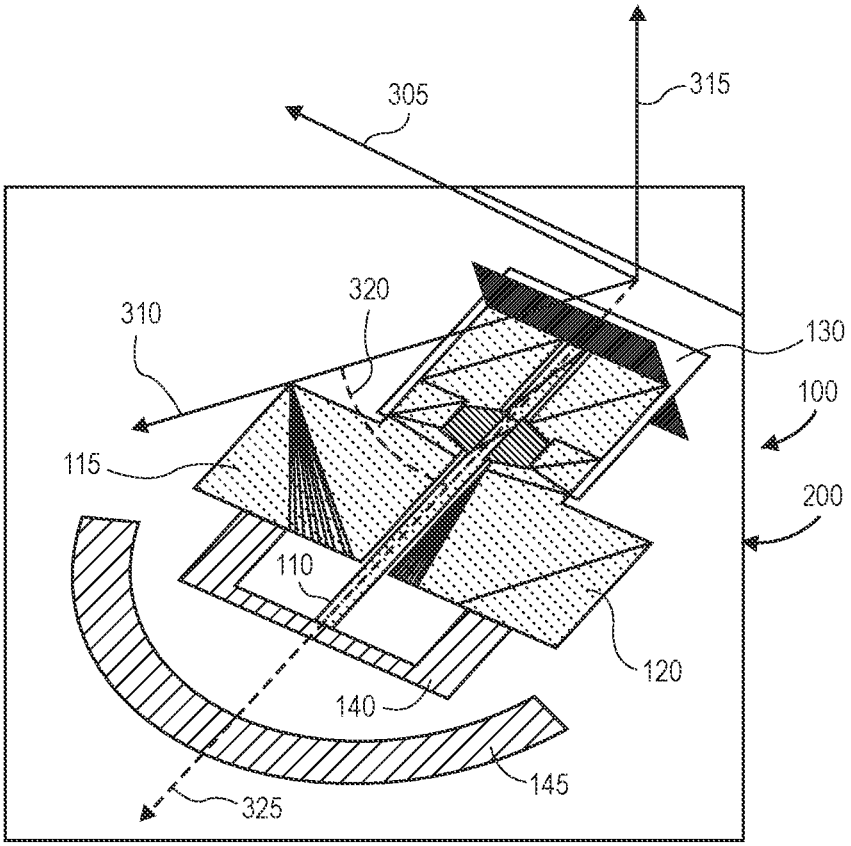
FIG. 3 is another diagram of the coplanar antenna structure disposed within the glass laminated structure.

FIGS. 1 through 3 illustrate an example coplanar antenna structure 100. The coplanar antenna structure 100 can be shaped and patterned into a transparent conductor where an antenna and ground conductors are printed on the same layer. In other words, a coplanar antenna is a structure in which all conductors supporting wave propagation are located on the same plane. The antenna can use low-cost thin films made of transparent conductive oxides and silver nano-wires with a high conductivity metal frame surrounding the antenna elements. In various implementations, the coplanar antenna structure 100 can operate at one or more frequency bands. For example, the coplanar antenna structure 100 can also operate in the 5.9 GHz frequency band. In another example, the coplanar antenna structure 100 can comprise a Wi-Fi antenna that operates in at least one of the 2.4 GHz and/or 5.8 GHz Wi-Fi frequency bands.

The coplanar antenna structure 100 is disposed on a substrate 105. For example, the coplanar antenna structure 100 can be fabricated on a flexible substrate 105, such as a printed circuit board comprised of Kapton or Mylar laminate. The coplanar antenna structure 100 also includes a feed line 110, e.g., transmission line, disposed between ground portions 115, 120. One end 125 of the feed line 110 is electrically connected to a coplanar waveguide (CPW) feed structure 130, and the other end 135 of the feed line 110 is connected to a radiating portion 140 that defines a wide slot, or wide aperture, as discussed in greater detail below. It is understood that the end 125 and/or coplanar waveguide (CPW) feed structure 130 is separated from the coplanar antenna structure 100 by a transparent substrate (see FIG. 2). The radiating portion 140 is an antenna radiating element that forms a generally U-shaped structure that is configured to emit electromagnetic radiation.

The CPW feed structure 130 is configured to enable radio-frequency (RF) excitation of the coplanar antenna structure 100. For example, the CPW feed structure 130 can receive a signal and provides the signal to the feed line 110 through electromagnetic coupling, which then provides the signal to the radiating portion 140 for transmission.

The coplanar antenna structure 100 also include a scattering element 145 that at least partially surrounds the radiating portion 140. As shown, the scattering element 145 can comprise a semi-circular ring structure to serve to scatter and/or disturb surface waves propagating through a transparent structure. In an example implementation, the semi-circular ring structure comprises a continuous, i.e., non-segmented, structure. As discussed in greater detail herein, the coplanar antenna structure 100 is disposed within the transparent structure.

Within vehicle wireless communication environments, antennas typically require a wide field-of-view for vehicle-to-everything (V2X) communication. For example, V2X communications include one or more communication networks in which vehicles and roadside devices are the communicating nodes that provide one another with information, such as safety warnings and traffic information. V2X communications allow vehicles to communicate with other vehicles, infrastructure, and/or pedestrians, using wireless communications technologies such as, but not limited to, cellular, Bluetooth®, IEEE 802.11, dedicated short range communications (DSRC), ultra-wideband (UWB), and/or wide area networks (WAN).

As discussed above, the radiating portion 140 defines a wide slot to enhance radiation of electric fields in one or more desired directions. For example, to improve azimuth beamwidth, the coplanar antenna structure 100 can radiate additional electric fields to sides of the coplanar antenna structure 100 in addition to the forward direction.

As described above, the radiating portion 140 may formed in a generally U-shaped structure that defines a slot 143, e.g., an aperture, therein. In an example implementation, the slot 143 can have a width 150, e.g., slot width, of at least approximately eight millimeters (8 mm) and a length 160 of at least approximately twenty millimeters (20 mm). The slot 143 may comprise an area of at least approximately one hundred and sixty millimeters (160 mm). In some implementations, the width to length ratio of the slot 143 comprises approximately 0.4. An overall length 155 of the radiating portion 140 can be at least approximately thirty millimeters (30 mm). In some implementations, the slot dimensions correspond to a length 160 of approximately 1.04 $\lambda g$ and a width 150 of approximately 0.42 $\lambda g$, where $\lambda g$ represents a wavelength parameter within a dielectric medium at 5.9 GHz. In this context, the term "approximately" is known to those skilled in the art. Alternatively, the term "approximately" may be read to mean plus or minus 10%.

In one implementation, a scattering element distance 165 between the scattering element 145 and the radiating portion 140 comprises at least approximately nine and a half millimeters (9.5 mm) and an exterior distance 170 comprises at least approximately five millimeters (5 mm). The scattering element distance 165 can represent a distance as measured between an exterior front edge of the radiating portion 140 and a mid-inner surface edge of the scattering element 145 as shown in FIG. 1.

The exterior distance 170 can represent a distance as measured from an exterior side edge of the radiating portion 140 and an exterior side edge of the ground portions 115, 120. In another implementation, the semi-circular ring distance comprises at least approximately eighteen and a half millimeters (18.5 mm) and the exterior distance 170 comprises approximately zero millimeters (0 mm). However, it is understood that other distances 165, 170 may be used according to the implementation of the coplanar antenna structure 100.

FIGS. 2 and 3 illustrate example implementations of a transparent assembly 200 that includes the coplanar antenna structure 100. In some implementations, the transparent assembly 200 may be incorporated into a vehicle, such as a windshield, side transparent, or rear transparent of a car, truck, bus, train, plane, boat, tractor, ATV, etc. In other implementations, the transparent assembly 100 may be incorporated into a stationary structure, such as a building having transparent windows. In other implementations, the radiating aperture 100 could be moved to 220 between the first glass 205 and the feeding structure 125 and implemented as an applique to the glass 220.

Referring to FIGS. 2 and 3, the transparent assembly 200 includes a first transparent substrate 205 and a second transparent substrate 210, laminated together to define a laminated structure 215. The coplanar antenna structure 100 is disposed, i.e., sandwiched, between the substrates 205, 210 within the laminated structure 215. The substrates 205, 210 can be laminated together using a suitable binding material 218, such as Polyvinyl butyral (PVB).

In an example implementation, the transparent substrates 205, 210 are glass substrates. However, in other implementations, the transparent substrates 205, 210 may be manufactured from some other transparent material.

As shown in FIG. 2, the CPW feed structure 130 may be mounted to an external surface 220 of the glass substrate 205. In this implementation, the external surface 220 is oriented to an interior of the vehicle.

FIG. 3 illustrates an isometric view of the coplanar antenna structure 100 within the transparent assembly 200 in which the transparent assembly 200 comprises a portion of a windshield of a vehicle. Axis 305 represents the X-axis, axis 310 represents the Y-axis, and axis 315 represents the Z-axis within the Cartesian coordinate system. When the coplanar antenna structure 100 is disposed within the windshield, the coplanar antenna structure 100 comprises a rake angle 320 ranging between approximately twenty-two degrees (22°) and approximately twenty-three degrees (23°). The rake angle 320 can be represented as the angle between axis 310, e.g., the Y-axis, and axis 325, which represents the Y'-axis. Within this implementation, a roof of the vehicle is defined within the X-Y plane.

Figure 4:
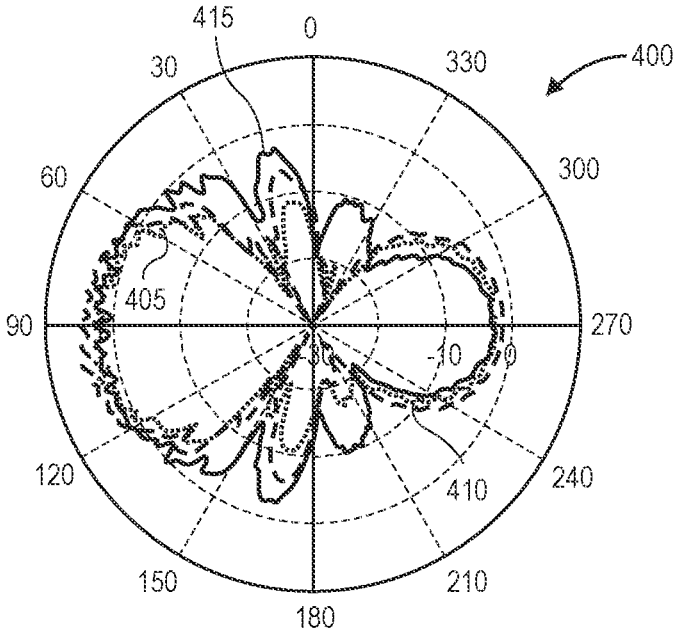
FIG. 4 is a diagram of simulated radiation patterns corresponding to coplanar antenna structure having differing slot widths.

FIG. 4 illustrates a simulated radiation pattern 400 in which the rake angle 320 for the corresponding coplanar antenna structures ranges between approximately twenty-two degrees (22°) and approximately twenty-three degrees (23°). The radiation pattern illustrates an azimuth pattern 405 corresponding to coplanar antenna structure having a slot width of two millimeters (2 mm), an azimuth pattern 410 corresponding to coplanar antenna structure having a slot width of four millimeters (4 mm), and an azimuth pattern 415 corresponding to coplanar antenna structure having a slot width of eight millimeters (8 mm). As shown, the azimuth pattern 415 is relatively increased as compared to the azimuth patterns 405, 410 in which the corresponding slot widths are relatively smaller.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. An antenna for a windshield of a vehicle, the antenna comprising:

a coplanar antenna structure, the coplanar antenna structure comprising:

a substrate;

a feed line disposed over the substrate and connected between a pair of ground portions;

a radiating portion that is configured to emit electromagnetic radiation and is disposed over the substrate, wherein the radiating portion defines a slot having a width to length ratio of 0.36 to 0.44, wherein the slot has a length of twenty millimeters, and wherein the feed line extends through the slot; and a scattering element disposed over the substrate and at least partially surrounding the radiating portion, wherein the scattering element comprises a semicircular ring structure.

2. The antenna as recited in claim 1, wherein a width of the slot comprises approximately eight millimeters.

3. The antenna as recited in claim 1, wherein an area of the slot comprises approximately one hundred and sixty millimeters squared.

4. The antenna as recited in claim 1, wherein the semicircular ring structure comprises a non-segmented structure.

5. The antenna as recited in claim 1, wherein the feed line connects the radiating portion to a coplanar waveguide (CPW) feed structure.

6. The antenna as recited in claim 1, further comprising a laminated structure that includes the coplanar antenna structure.

7. The antenna as recited in claim 6, wherein the laminated structure comprises a first transparent substrate and a second transparent substrate bonded together via a binding material.

8. The antenna as recited in claim 7, wherein the binding material comprises Polyvinyl butyral (PVB).

9. A system comprising:

a laminated structure; and an antenna disposed within the laminated structure, the antenna comprising a coplanar antenna structure, the coplanar antenna structure comprising:

a substrate;

a feed line disposed over the substrate and connected between a pair of ground portions;

a radiating portion that is configured to emit electromagnetic radiation and is disposed over the substrate, wherein the radiating portion defines a slot having a width to length ratio of 0.36 to 0.44, wherein the slot has a length of twenty millimeters, and wherein the feed line extends through the slot; and a scattering element disposed over the substrate and at least partially surrounding the radiating portion, wherein the scattering element comprises a semicircular ring structure.

10. The system as recited in claim 9, wherein a width of the slot comprises approximately eight millimeters.

11. The system as recited in claim 9, wherein an area of the slot comprises approximately one hundred and sixty millimeters squared.

12. The system as recited in claim 9, wherein the semicircular ring structure comprises a non-segmented structure.

13. The system as recited in claim 9, wherein the feed line connects the radiating portion to a coplanar waveguide (CPW) feed structure.

14. The system as recited in claim 13, wherein the coplanar waveguide (CPW) feed structure is disposed over an external surface of the laminated structure.

15. The system as recited in claim 9, wherein the laminated structure comprises a first transparent substrate and a second transparent substrate bonded together via a binding material.

16. The system as recited in claim 15, wherein the binding material comprises Polyvinyl butyral (PVB).

* * * * *